US005335577A

United States Patent [19]

Babb et al.

[11] Patent Number: 5,335,577

[45] Date of Patent: Aug. 9, 1994

[54] METHOD AND APPARATUS FOR PREVENTING HAZARDOUS EXPLOSION OF AMMONIUM NITRATE

[75] Inventors: Steven J. Babb; John L. Harmon, both of Wilmington, N.C.

[73] Assignee: General Electric Company, San Jose, Calif.

[21] Appl. No.: 60,133

[22] Filed: May 13, 1993

[51] Int. Cl.[5] ..... F42B 3/20; F23N 5/22

[52] U.S. Cl. ..... 86/21; 86/20.1; 86/45; 102/705; 149/109.6; 431/6

[58] Field of Search ..... 86/20.1, 21, 45; 102/705; 149/109.6; 431/6

[56] References Cited

PUBLICATIONS

Loss Prevention Data Sheet 7-89, Factory Mutual System, Mar. 1977, pp. 1-6.

ANSI/UL 1020-1986, Thermal Cutoffs for Use in Electrical Appliances and Components, Underwriters Laboratories Inc., 4th Ed. (1988).

*Primary Examiner*—Peter A. Nelson

*Attorney, Agent, or Firm*—J. S. Beulick

[57] ABSTRACT

A one-shot thermal fuse mounted directly on the casing of a centrifugal pump to prevent overheating and concentration of ammonium nitrate. The thermal fuse is screwed into a standard pipe coupling welded to a designated location on the pump casing. The thermal fuse has an electrical contact connected in the pump control circuit. A compressed spring is prevented from urging the electrical contact into an open position by a pellet of fusible material which is designed to melt at a desired threshold temperature below the temperature at which ammonium nitrate explodes. If the heat produced by the pump melts the pellet of fusible material, the spring is released, thereby opening the electrical contact and shutting off the pump. Alternatively, the temperature-sensitive element mounted on the pump casing can be a thermocouple or a temperature switch having a bimetallic element.

20 Claims, 2 Drawing Sheets

METHOD AND APPARATUS FOR PREVENTING HAZARDOUS EXPLOSION OF AMMONIUM NITRATE

FIELD OF THE INVENTION

This invention generally relates to the chemical processing of chemical solutions which are liable to explode when concentrated, confined and heated. In particular, the invention relates to a method for preventing the explosion of concentrated ammonium nitrate solutions when confined at high temperature in a centrifugal pump.

BACKGROUND OF THE INVENTION

Concentrated ammonium nitrate solutions are common in chemical processing. For example, ammonium nitrate for use as agricultural fertilizer is produced in significant quantities. Also, metal nitrate solutions such as uranyl nitrate are often precipitated with aqueous ammonia to yield an ammonium nitrate waste stream.

Under certain conditions, molten or crystalline ammonium nitrate may explode due to sudden decomposition. Sudden decomposition of ammonium nitrate releases a large volume of gas and a great quantity of heat, occasionally resulting in a detonating pressure. Historically, many industrial injuries and deaths have been caused by the accidental explosion of ammonium nitrate.

Hazardous explosion of ammonium nitrate is not possible unless three conditions are simultaneously met: (1) concentrated ammonium nitrate; (2) heat; and (3) confinement. Ammonium nitrate susceptible to explosion may be in either liquid or solid form, and total confinement is not necessary. While explosive decomposition occurs at 260° C. for pure ammonium nitrate, certain chemical sensitizers lower the decomposition temperature. Also, chemical process design features that avoid concentration, heat, and confinement help ensure safety despite the possibility of human error. These features include temperature and flow interlocks to ensure unblocked pump flow, and piping details that prevent inadvertent blockage.

Ammonium nitrate decomposes according to either of two reactions under different conditions. Under low-pressure conditions such as atmospheric, $NH_4NO_3$ decomposes rather harmlessly into ammonia and nitric acid:

$$NH_4NO_3 \rightarrow NH_3 + HNO_3$$

Under confining conditions which allow buildup of high pressure, the decomposition occurs according to a hazardous reaction called rapid thermal decomposition:

$$NH_4NO_3\ (\text{aqueous}) \rightarrow N_2O\ (\text{gas}) + 2H_2O\ (\text{gas})$$

The latter reaction occurs extremely rapidly, creating a pressure wave which accounts for the explosion. This reaction also produces significant heat, which further increases the decomposition rate and also amplifies the gas pressure. Once the reaction is initiated, decomposition may accelerate such that the time scale for the entire event is just several milliseconds. The confining conditions which allow pressure to build up from the hazardous decomposition do not need to be total. In fact, a partially blocked pump discharge is sufficient to create the hazard of explosion.

Centrifugal pumps, such as those conventionally used to pump ammonium nitrate during chemical processing, are capable of creating all of the conditions necessary for hazardous ammonium nitrate explosions. A partially blocked pump can create heat to gradually increase the temperature until the reaction is initiated. This heat also allows the second of the three conditions to occur, i.e., concentration of the ammonium nitrate. Finally, partial or total pump blockage may result in sufficient confinement to allow rapid pressure build up and the potential for explosion.

Depending on the acceleration rate of the rapid thermal decomposition, the explosion may be of two types. In the first, most common, type of explosion, the pressure wave simply ruptures process equipment in proximity. However, an extremely high rate of decomposition may result in a pressure wave which moves at the speed of sound (e.g. sonic); such a pressure wave is completely unyielding and extremely powerful. This class of explosion is a detonation that can disintegrate process equipment into tiny pieces with high force.

Pure ammonium nitrate decomposes by hazardous thermal decomposition at 260° C. and 1422 psi. Impurities may significantly affect the decomposition temperature, rate, or potential. For example, the presence of certain sensitizing materials, such as metal particles (especially aluminum), wax, chlorinated materials, organics including hydrocarbons and wood, and other compounds, lowers the temperature and pressure thresholds required for an explosion. Certain substances such as calcium oxide (lime) stabilize ammonium nitrate and increase the temperature and pressure thresholds.

Safety standards recommend designs that limit the temperature of ammonium nitrate solutions, using electronic instrumentation and other features to prevent blocked flow. One such standard recommends the use of instrumentation to control temperatures of highly concentrated solutions below 370° F. (188° C.). The recommended interlock stops the pump when the liquid temperature nears the decomposition temperature of ammonium nitrate.

Conventional instrumentation loops to provide this control are expensive to install and maintain, and must be periodically calibrated and functionally tested. An analog temperature interlock typically consists of a thermocouple or resistive temperature device located in piping near the pump. The thermocouple is connected to an electronic transmitter, which is in turn connected via coaxial cable to a control system. The control system may be either a distributed control system or a current switch which controls the motor start circuit. Each component in this conventional system is complex and requires periodic maintenance and calibration.

Somewhat simpler temperature switches are used in piping adjacent to pumps. These switches usually include a bimetallic element which opens an electrical circuit and stops the pump. However, these switches must be periodically calibrated and tested. Also such temperature switches are not mounted directly on the pump casing, which is where high pump temperatures can be most reliably detected.

SUMMARY OF THE INVENTION

The present invention improves upon conventional methods for preventing the explosion of concentrated ammonium nitrate solutions during pumping. The invention comprises a temperature-sensitive element mounted directly on the casing of a centrifugal pump to prevent overheating and concentration of ammonium nitrate or any other chemical solution which has the potential to explode when concentrated, confined and heated. The temperature-sensitive element of the invention is screwed into a standard pipe coupling welded to a designated location on the pump casing.

In accordance with a preferred embodiment of the invention, the temperature-sensitive element mounted on the pump casing is a one-shot thermal fuse which has an electrical contact with open and closed states connected in the pump control circuit. A spring in a compressed state is arranged between the electrical contact and a support substrate. The spring is held in the compressed state by a pellet of fusible material which is fused to the substrate. The pellet material is designed to melt at a desired threshold temperature below the temperature at which ammonium nitrate explodes.

Heat emanating from the pump casing during pump operation is conducted to the thermal fuse via the pipe coupling. This conduction of heat causes the temperature of the thermal fuse element to rise. If the heat produced by the pump raises the temperature of the internal pellet above its melting point, the melted pellet material will no longer maintain the spring in its compressed state. The released spring then forces open the electrical contact in the motor control circuit. The centrifugal pump stops and remains off until the fuse is replaced. This failure condition prevents restarting the pump, thereby providing an opportunity for adequate investigation to prevent a potential explosion.

Heat transfer to the temperature-sensitive element may be enhanced through the use of thermally conducting paste in the void spaces between the coupling and the thermal fuse. Also the thermal fuse is located on the pump casing at a place where the rotating liquid inside the pump chamber splashes the pump casing, which ensures that heat from the liquid will be conducted to the thermal fuse element, even if the pump is operating in a partially full state. A partially full pump chamber is likely if the pump discharge is partially blocked for a period of time and liquid evaporates due to frictional heating in the pump.

Evaporation of the solution inside the pump is undesirable because it concentrates the ammonium nitrate to a hazardous condition. The thermal fuse may be designed to melt at a temperature which substantially reduces evaporation. For example, a 20° C. temperature difference will usually occur between the temperature of the pumped liquid and the thermal fuse element; the thermal fuse may be designed to melt at 75° C., such that the liquid will not boil. The invention provides the advantage of avoiding both excessive concentration and hazardous temperature.

The application of commercial thermal fuses for protection of pumps is novel and unique, particularly for ammonium nitrate safety. The design of the thermal fuse mounting and circuit in accordance with the invention provides significant commercial cost advantage and greater safety reliability than conventional instrumentation and interlocks. The circuit is failsafe and self-verifying in that any interruption will result in a failsafe position.

In accordance with the invention, the mounting for the temperature-sensitive element is welded directly to the pump casing, whereas conventional instrumentation is mounted in adjacent piping. This is an improvement over the prior art because the transfer of heat from adjacent piping is not nearly as reliable as from the pump casing itself. This benefit is obtained even for alternative embodiments in which the temperature-sensitive element is a thermocouple or a temperature switch having a bimetallic element. However, a one-shot thermal fuse is preferred because of the following additional advantages.

In contrast to conventional means for shutting off an overheated pump filled with ammonium nitrate, the thermal fuse in accordance with the preferred embodiment of the invention requires neither calibration nor periodic testing. Thus the cost of installing and maintaining the thermal fuse is greatly reduced compared to the corresponding costs associated with conventional instrumentation. Other than installation and periodic visual and electrical verification, no other maintenance is required for the thermal fuse. Lastly, the thermal fuse of the invention is uniquely failsafe in that corrosion or physical damage to the element will open the motor control circuit, whereas conventional instruments require failsafe analysis of each component in the interlock.

DETAILED DESCRIPTION OF THE PREFERRED EMBODIMENTS

Figure 1:
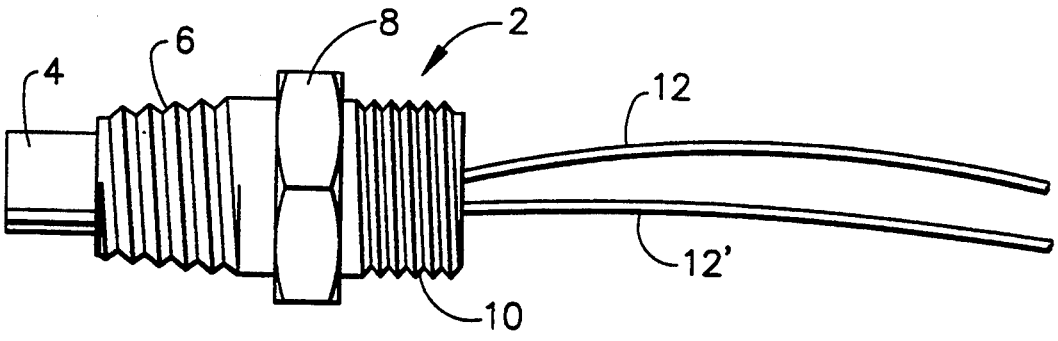
FIG. 1 is a side view of a thermal fuse in accordance with the preferred embodiment of the invention.

Referring to FIG. 1, the thermal fuse 2 in accordance with the preferred embodiment of the invention comprises a probe 4 made of thermally conductive material and a body having a coupling thread 6, a hexagonal head 8 and a conduit thread 10, all integrally connected. The body is preferably 316 stainless steel. Wire leads 12 and 12' provide interconnection of the fuse to the motor control circuit (described below).

Figure 3:
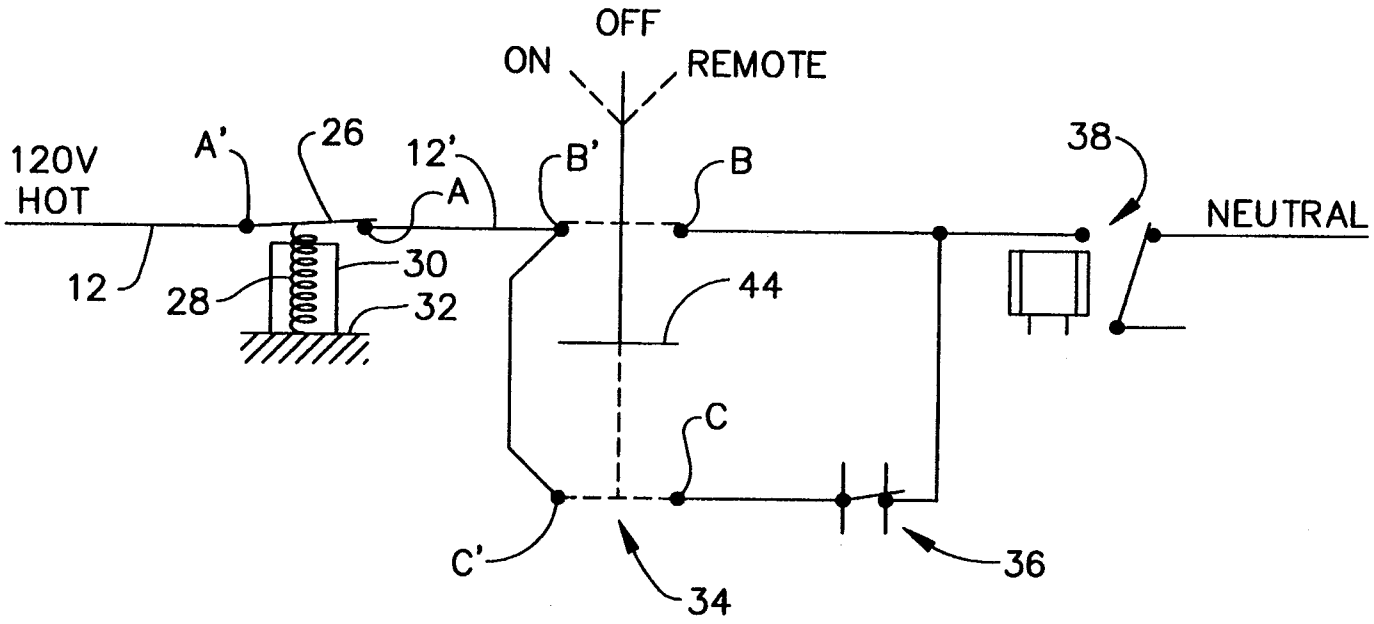
FIG. 3 is a diagram showing the electrical connection of the thermal fuse of FIG. 1 in the motor control circuit of a centrifugal pump in accordance with the invention.

Internal elements of probe 4 are schematically depicted in FIG. 3. Probe 4 has an electrical contact 26 with open and closed states. In the closed state, electrical contact 26 electrically couples terminals A and A', which are in turn respectively connected to wire leads 12 and 12'. A compressed spring 28 is arranged between the electrical contact 26 and a support substrate 32 inside probe 4. The spring 28 is held in the compressed state by a pellet 30 of fusible material which is fused to the substrate 32. The pellet material has a predetermined melting temperature.

Figure 2:
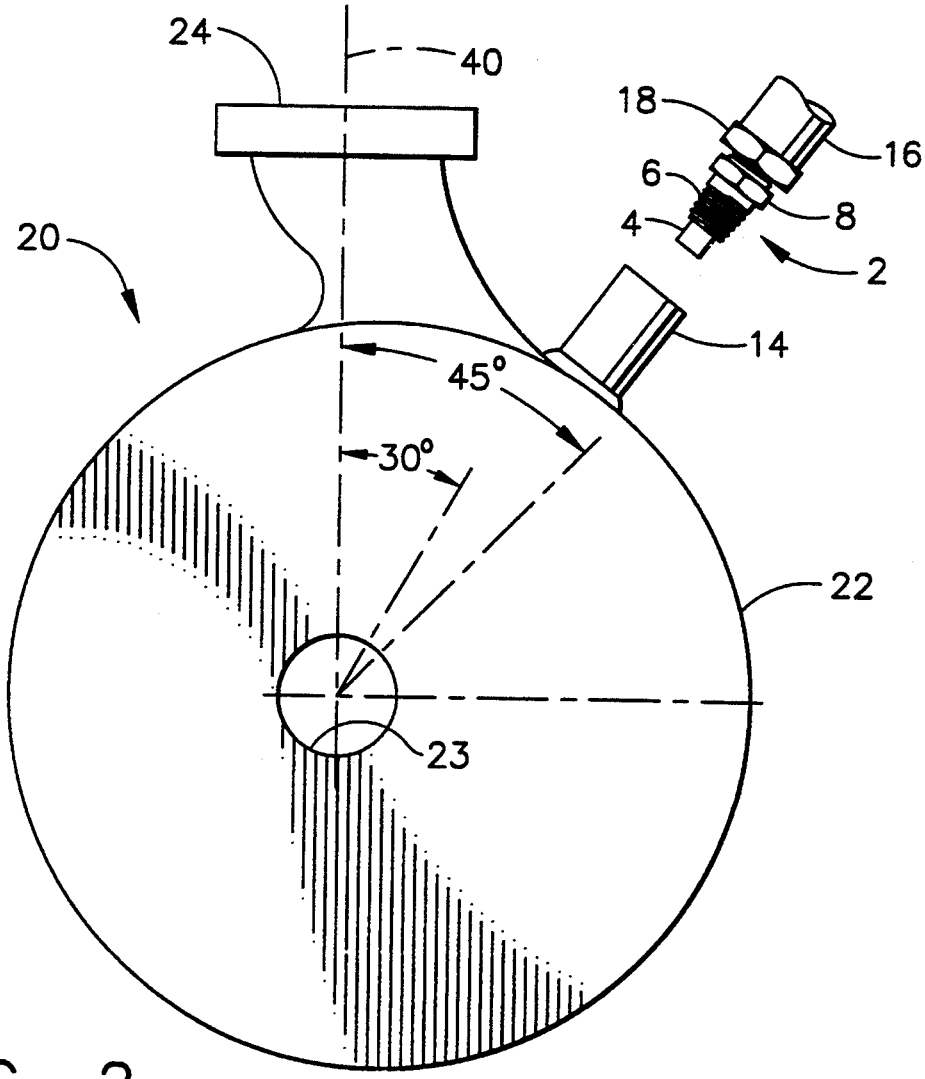
FIG. 2 is a diagram showing the thermal fuse of FIG. 1 being installed on a pump casing in accordance with the method of installation of the invention.

In accordance with the preferred embodiment of the invention, the thermal fuse 2 is thermally coupled to the casing 22 of a centrifugal pump 20 having a discharge outlet 24 (see FIG. 2). This is accomplished by welding a standard threaded pipe coupling 14 at a predetermined location on pump casing 22. The pipe coupling may be ½-inch-diameter stainless steel. A full weld of the coupling is desirable. Preferably, minimum heat is used to weld the coupling to the pump in order to prevent degradation of the casing's corrosion resistance. Chemical bonding compounds can also be used.

The cavity of coupling 14 contains a thermally conductive compound which fills the void spaces between fuse 2 and coupling 14. The preferred compound is a nonhardening heat transfer cement commercially available from Thermon, 100 Thermon Drive, San Marcos, Tex., under the product designation E-1. E-1 heat transfer cement is a graphite-based resin with heat-conducting properties similar to those of cast iron. This cement comprises azelate polyester (Plastolein 9789), synthetic graphite (10 $mg/m^3$), natural graphite (5 $mg/m^3$) and calcium metasilicate (10 $mg/m^3$). This compound has a boiling point in excess of 540° F.

Preferably the welded pipe coupling 14 occupies a position in the sector extending from 30 to 45 degrees relative to an axis 40, drawn from the axis of rotation of the pump impeller (not shown) through the center of the discharge outlet 24 as shown in FIG. 2. The mounting position near pump discharge 24 ensures that the liquid being pumped will heat the area of the pump where the fuse is located, even if liquid only partly fills the pump. The liquid enters the pump chamber via suction inlet 23.

To install the thermal fuse, first the hexagonal head 18 of a conduit 16 is screwed onto conduit thread 10 of thermal fuse 2. Conduit 16 houses wire leads 12 and 12'. After the cavity in coupling 14 is filled with heat transfer cement, thread 6 of thermal fuse 2 is screwed into threaded pipe coupling 14 to an approximately hand-tightened state. FIG. 2 shows the thermal fuse 2 connected to conduit 16 just prior to insertion in pipe coupling 14.

As shown in FIG. 3, wire lead 12 connects terminal A' to a 120-V voltage source. Wire lead 12' connects terminal A to terminal B' of an On-Off-Remote switch 34. In the On state, the contact 44 of switch 34 bridges terminals B and B'; in the Remote state, contact 44 bridges terminals C and C'; and in the OFF state, contact 44 bridges neither terminals B—B' nor terminals C—C'. In the ON state, the motor start relay 38 is coupled to the pump by way of electrical contact 26 and remote switch 36.

As is apparent from FIG. 3, electrical contact 26 of thermal fuse 2 overrides all motor controls. Thus the thermal fuse of the invention prevents overheating of the pump casing by breaking the electrical circuit controlling the pump if the surface temperature of the pump exceeds 171° F. (77° C.).

The thermal fuse of the invention is completely sealed in a stainless steel body and never requires calibration. If the fuse were to corrode or the circuit wiring were to fail, the electrical circuit would open to safely stop the pump. Additionally, the fuse is always wired directly to the motor control center ("MCC") such that all troubleshooting of the pump circuit can be done at the MCC.

The fuse is always the first element in motor control circuits, so that if the fuse is triggered by an overheated pump, the pump will not run no matter which position hand switches may be set or even if commanded to run by computer control. Control room indications of a pump cutoff are identical to switching the motor off at the MCC breaker. Therefore, computer control systems will show a failed pump on the graphics display.

Tests verified that the thermal fuse of the present invention will detect an overheated pump condition if mounted on pumps with ½-inch stainless steel couplings and heat transfer cement. The test rig consisted of a ⅝-inch-thick block of 304L stainless steel with the coupling fully welded to the block. A thermocouple was used to measure the temperature on the lower (heated) side of the block while a second thermocouple measured the temperature at the thermal fuse tip. The block was heated from room temperature to 125° C. in 20–30 minutes.

The test data indicated that the temperature at the fuse tip lagged the temperature on the other side of the steel block by 20° C. Therefore, the fuse specification (melting at 77° C.) ensures that the liquid will not reach boiling temperatures (e.g., 100° C.) within the pump casing. Boiling liquid would produce significantly concentrated ammonium nitrate, such that further heat and confinement could potentially result in an explosion. This analysis is conservative, since most pump casings used in the processing of ammonium nitrate are thinner than ⅝ inch and are not sufficiently powered to heat liquids to boiling temperature in 20 minutes.

The foregoing preferred embodiment has been disclosed for the purpose of illustration. Variations and modifications of the disclosed preferred embodiment will be readily apparent to practitioners skilled in the art of thermal cutoffs. For example, the pellet in the thermal fuse may alternatively be an electrically conductive, fusible material which contacts and bridges a pair of junctions in the motor control circuit. The electrically conductive coupling of these junctions is broken when the pellet material melts. Alternatively, a temperature switch having a bimetallic element which bridges a pair of junctions in the motor control circuit could be installed in a pipe coupling welded on the pump casing. In accordance with yet another alternative embodiment, a thermocouple could be installed in the pipe coupling welded on the pump casing. All such variations and modifications are intended to be encompassed by the claims set forth hereinafter.

We claim:

1. A device for preventing explosion of a potentially explosive chemical solution inside a pump, said pump having a motor controlled by a motor control circuit and a casing with a suction inlet and a discharge outlet, comprising:

thermal cutoff means for opening said motor control circuit when said thermal cutoff means reaches a predetermined threshold temperature; and means for attaching said thermal cutoff means to said pump casing.

2. The device as defined in claim 1, wherein said attaching means comprises a threaded coupling welded to an outside surface of said pump casing and said thermal cutoff means comprises a thread for threadably engaging said threaded coupling.

3. The device as defined in claim 2, wherein said threaded coupling has a first axis and said discharge outlet of said pump has a second axis, said threaded coupling being welded to said pump casing at a position such that the angle between said first and second axes lies in the range of 30 to 45 degrees.

4. The device as defined in claim 1, wherein said thermal cutoff means comprises a probe and means for engaging said attaching means, and said attaching means comprises a cavity for receiving said probe and means for engaging said engaging means of said thermal cutoff means.

5. The device as defined in claim 4, further comprising heat conduction means for conducting heat from said attaching means to said probe, said heat conduction means filling open space between said probe and said cavity.

6. The device as defined in claim 5, wherein said heat conduction means comprises thermally conductive paste.

7. The device as defined in claim 4, wherein said probe comprises fusible material which melts at said predetermined threshold temperature, an electrical contact which connects first and second terminals of said motor control circuit in a first state and disconnects said first and second terminals of said motor control circuit in a second state, and means for changing said electrical contact from said first state to said second state in response to melting of said fusible material.

8. The device as defined in claim 1, wherein said thermal cutoff means comprises fusible material which melts at said predetermined threshold temperature, an electrical contact which connects first and second terminals of said motor control circuit in a first state and disconnects said first and second terminals of said motor control circuit in a second state, and means for changing the state of said electrical contact from said first state to said second state in response to melting of said fusible material.

9. The device as defined in claim 8, wherein said means for changing the state of said electrical contact comprises a compressed spring embedded in said fusible material, said compressed spring releasing in response to melting of said fusible material to urge said electrical contact into said second state.

10. The device as defined in claim 1, wherein said predetermined threshold temperature is less than the boiling temperature of said chemical solution.

11. A system for pumping a potentially explosive chemical solution, comprising:

a pump having a motor and a casing with a suction inlet and a discharge outlet;

a motor control circuit for controlling said pump motor;

thermal cutoff means for opening said motor control circuit when said thermal cutoff means reaches a predetermined threshold temperature; and means for attaching said thermal cutoff means to said pump casing.

12. The system as defined in claim 11, wherein said attaching means comprises a threaded coupling welded to an outside surface of said pump casing and said thermal cutoff means comprises a thread for threadably engaging said threaded coupling.

13. The system as defined in claim 11, wherein said thermal cutoff means comprises fusible material which melts at said predetermined threshold temperature, an electrical contact which connects first and second terminals of said motor control circuit in a first state and disconnects said first and second terminals of said motor control circuit in a second state, and means for changing the state of said electrical contact from said first state to said second state in response to melting of said fusible material.

14. The system as defined in claim 13, wherein said means for changing the state of said electrical contact comprises a compressed spring embedded in said fusible material, said compressed spring releasing in response to melting of said fusible material to urge said electrical contact into said second state.

15. The system as defined in claim 11, wherein said predetermined threshold temperature is less than the boiling temperature of said chemical solution.

16. The system as defined in claim 11, wherein said thermal cutoff means comprises a probe and means for engaging said attaching means, and said attaching means comprises a cavity for receiving said probe and means for engaging said engaging means of said thermal cutoff means, further comprising heat conduction means for conducting heat from said attaching means to said probe, said heat conduction means filling open space between said probe and said cavity.

17. A method for preventing explosion of a potentially explosive chemical solution inside a pump, said pump having a motor controlled by a motor control circuit and a casing with a suction inlet and a discharge outlet, comprising the following steps:

mounting a temperature-sensitive element on said pump casing so that heat emanating from said pump casing is conducted to said temperature-sensitive element, said temperature-sensitive element undergoing a change of state in response to a predetermined threshold temperature; and opening said motor control circuit in response to said change of state of said temperature-sensitive element, whereby operation of said pump is halted.

18. The method as defined in claim 17, wherein said mounting step comprises the steps of:

welding a coupling having a cavity onto said pump casing;

filling at least a portion of said cavity with a thermally conductive paste; and installing said temperature-sensitive element inside said cavity of said coupling, wherein the amount of thermally conductive paste in said cavity is sufficient to fill open spaces between said temperature-sensitive element and said cavity.

19. The method as defined in claim 17, wherein said temperature-sensitive element comprises a pellet of fusible material which melts at said predetermined threshold temperature, said motor control circuit being opened in response to melting of said fusible material.

20. The method as defined in claim 17, wherein said predetermined threshold temperature is less than the boiling temperature of said chemical solution.

* * * * *